US005615999A

United States Patent [19]

Sukup

[11] Patent Number: 5,615,999

[45] Date of Patent: Apr. 1, 1997

[54] AXIAL FAN HOUSING WITH INTEGRAL VENTURI

[75] Inventor: Charles E. Sukup, Dougherty, Iowa

[73] Assignee: Sukup Manufacturing Company, Sheffield, Iowa

[21] Appl. No.: 450,208

[22] Filed: May 25, 1995

[51] Int. Cl.[6] ..... F01D 1/00

[52] U.S. Cl. ..... 415/182.1; 415/220

[58] Field of Search ..... 415/182.1, 208.1, 415/220

[56] References Cited

U.S. PATENT DOCUMENTS

| | | | |
|---|---|---|---|
| 3,118,594 | 1/1964 | Helmbold | 415/208.1 |
| 3,500,842 | 3/1970 | Birch | 415/182.1 |
| 3,574,480 | 4/1971 | Hoepfner | 415/182.1 |
| 3,619,080 | 11/1971 | Bullock | 415/214.1 |
| 4,711,395 | 12/1987 | Handfield | 415/220 |
| 5,000,079 | 3/1991 | Mardis | 415/220 |
| 5,158,432 | 10/1992 | Cox | 415/214.1 |
| 5,221,182 | 6/1993 | Arbeus | 415/208.1 |
| 5,304,034 | 4/1994 | Bouwman | 415/214.1 |

FOREIGN PATENT DOCUMENTS

| | | | |
|---|---|---|---|
| 777259 | 11/1980 | U.S.S.R. | 415/220 |
| 229526 | 12/1928 | United Kingdom | 415/220 |

OTHER PUBLICATIONS

Sukup Axial Fan & Heater Brochure–Dated Jan., 1990.

*Primary Examiner*—John T. Kwon

*Attorney, Agent, or Firm*—Zarley, McKee, Thomte, Voorhees & Sease

[57] ABSTRACT

A vane axial fan housing includes a main body having an outlet end and an inlet end opposite the outlet end. An inlet endplate is secured across the inlet end of the main body and has an inlet opening therein circumscribed by an adjacent venturi-shaped flange integrally formed in the inlet endplate so as to extend toward the outlet end. The venturi-shaped flange also serves to mount the inlet endplate to the inlet end of the main body.

1 Claim, 2 Drawing Sheets

AXIAL FAN HOUSING WITH INTEGRAL VENTURI

BACKGROUND OF THE INVENTION

The present invention relates to the field of fans for displacing air. More particularly, the invention relates to vane-axial fans for aerating, heating, or drying agricultural spaces and grain stored therein. The present invention provides an improved housing having an integral venturi for such fans.

Axial fans and heaters are well known in the agricultural arts. Such fans are typically mounted to the outside of a grain bin near its bottom. The outlet end of the fan housing communicates with the grain bin while the inlet end extends outside the bin. The inlet end typically includes a vertical endplate having an inlet opening. Outside air is drawn through the inlet opening then circulated through the bin to dry or aerate the grain before being vented from the bin.

Attaching a venturi to the inlet end of the fan has been found helpful in reducing fan inlet losses due to turbulance, and thus enhances air flow performance. Existing venturis for axial fans comprise a separate ring-shaped attachment mounted on the inlet endplate outwardly adjacent the intake opening. These venturi attachments protrude outwardly beyond the inlet endplate, which lengthens the overall package length of the fan and invites damage from collisions.

Therefore, a primary object of the present invention is the provision of a fan housing with a venturi integrally formed therein.

Another object of the present invention is the provision of a fan housing with a venturi that minimizes the overall length of the fan.

Another object of the present invention is the provision of a fan housing that streamlines the profile of the fan to minimize the risk of damage due to collisions, and to reduce cost of fabrication.

These and other objects will become apparent from the following description and the accompanying drawings.

SUMMARY OF THE INVENTION

The present invention provides an integral venturi housing for an vane axial fan. The housing includes a main body having an outlet end and an inlet end opposite the outlet end. An inlet endplate is secured across the inlet end of the main body of the housing and has an inlet opening therein circumscribed by an adjacent venturi-shaped flange integrally formed in the inlet endplate so as to extend axially into the main body toward the outlet end. The inlet end of the main body can be fitted and secured against the inner surface of the flange to hold the inlet endplate in place.

DETAILED DESCRIPTION OF THE PREFERRED EMBODIMENT

Figure 1:
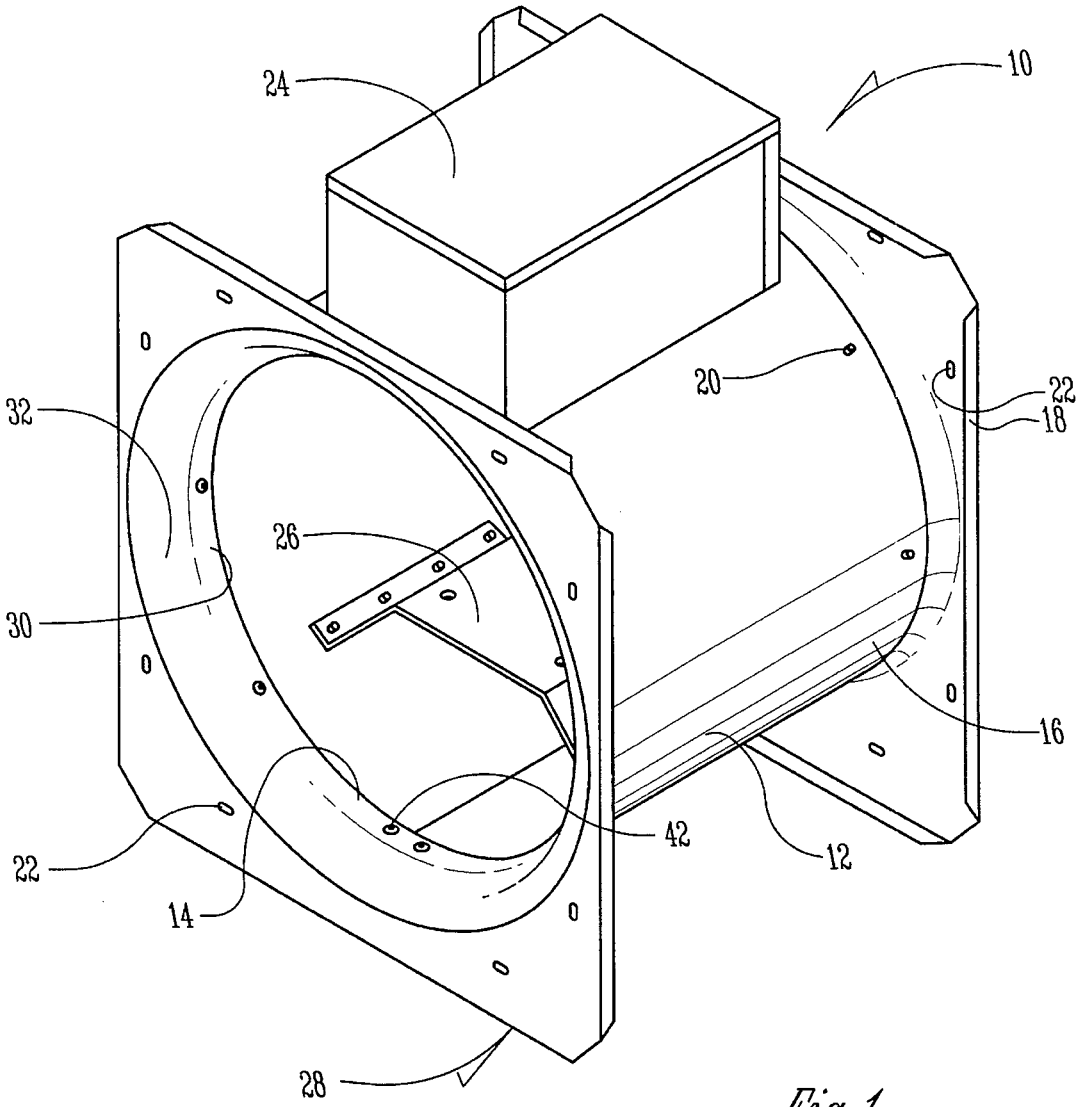
FIG. 1 is a perspective view of the fan housing of the present invention.

The axial fan housing of the present invention is generally denoted by reference numeral 10 in FIG. 1. The fan housing 10 includes a main body 12, which is preferably cylindrical in shape. The main body 12 includes an inlet end 14 and an outlet end 16 located generally opposite the inlet end 14.

An outlet endplate 18 is connected to the main body 12 at its outlet end 16 and extends generally transverse to the main body 12. The outlet endplate 18 is preferably rectangular or square in shape to facilitate the resting of the housing 10 on the ground or a similar supporting surface. Conventional fastening means 20 secure the outlet endplate 18 to the main body 12. Furthermore, apertures 22 extend through the outlet endplate 18 for attaching it to a heater or transition duct communicating with a grain bin wall or similar structure with conventional fastening means (not shown).

A control box 24 is mounted on the main body 12 of the housing 10 for controlling the fan motor (not shown) mounted on a platform 26 disposed inside the main body 12 of the housing 10.

An inlet endplate 28 similar to the outlet endplate 18 is vertically disposed generally opposite the outlet endplate 18. The inlet endplate 28 further includes an inlet opening 30 that is circumscribed by an adjacent venturi-shaped flange 32. The flange 32 is integrally formed in the inlet endplate 28 so as to extend axially into the main body 12 toward the outlet endplate 18. The inlet endplate 28 also includes apertures 22 for mounting purposes. As shown in FIG. 1, the main body 12 is supported on endplates 18 and 28.

Figure 3:
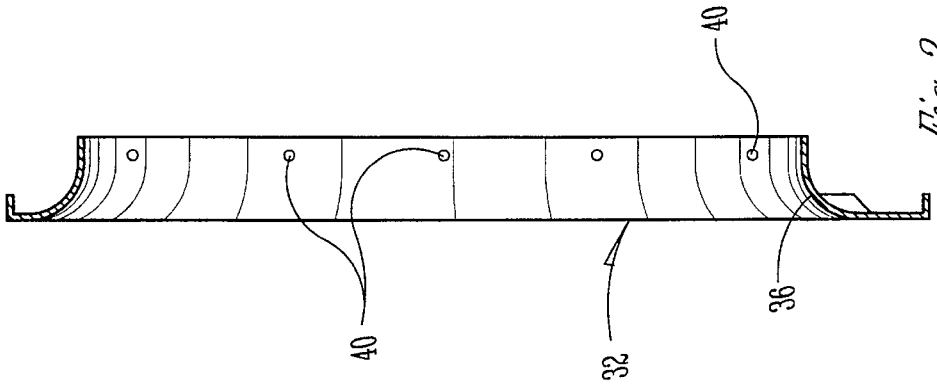
FIG. 3 is a sectional view of the inlet endplate taken along line 3—3 in FIG. 2.
Figure 2:
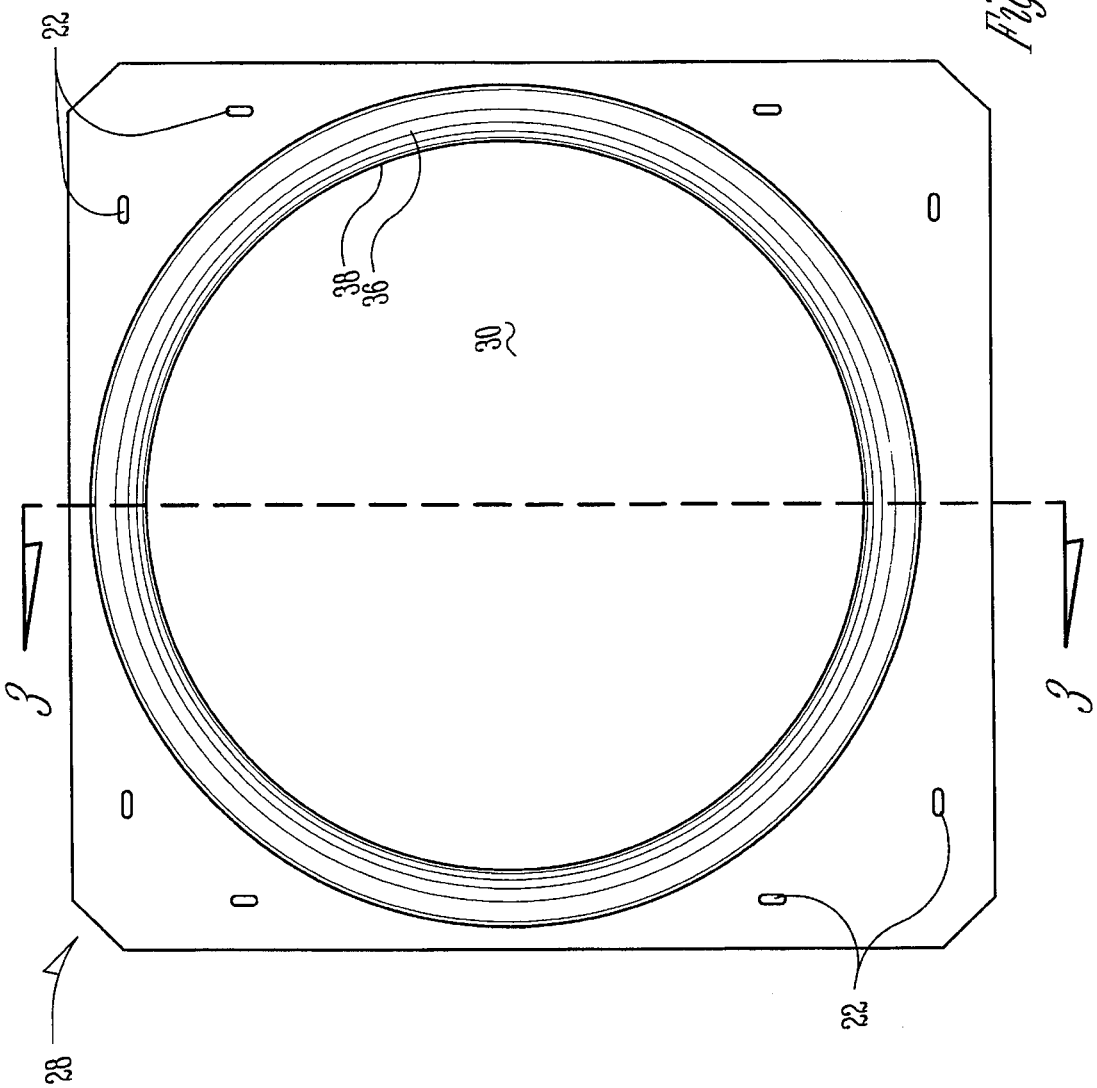
FIG. 2 is a front elevation view of the inlet endplate of the fan housing of FIG. 1.

As best seen in FIGS. 2 and 3, the venturi-shaped flange 32 has a largest or major diameter 34 that is wholly contained within the inlet endplate 28. Preferably, the venturi-shaped flange 32 is a continuous ring having a curved inner surface 36 which extends axially from the major diameter 34 to a smallest or minor diameter 38.

Preferably, holes 40 extends through the venturi-shaped flange 32 near its minor diameter 38 for securing the inlet endplate 28 to the main body 12 with conventional fastening means 42 as shown in FIG. 1. Thus, an inlet opening 44 is defined by the intersection of the inlet end 14 of the main body 12 and the venturi-shaped flange 32.

It will be understood that the size and shape of the main body, the endplates and even the periphery of the venturi flange can be varied without detracting from the present invention.

Whereas the invention has been shown and described in connection with the preferred embodiments thereof, it will be understood that modifications, substitutions, and additions may be made which are within the intended broad scope of the following claims. From the foregoing, it can be seen that the present invention accomplishes at least all of the stated objectives.

What is claimed is:

1. A housing for an axial fan, comprising:

an elongated cylindrical main body having an outlet end and an inlet end opposite the outlet end;

a rectangular vertical endplate secured across the inlet end of the main body of the housing and having a circular inlet opening therein circumscribed by a venturi-shaped flange integrally formed in the inlet endplate so as to extend inwardly into communication with said main body toward the outlet end from the inlet end, said endplate having a lower portion having a straight horizontal edge to support said body in a stabilized horizontal position, and said venturi shaped flange having a circular transverse cross section, a second rectangular vertical endplate on the outlet end of said body having a straight horizontal edge to support said body in a stabilized horizontal position.

* * * * *